US012110682B2

(12) United States Patent
Russo

(10) Patent No.: US 12,110,682 B2
(45) Date of Patent: Oct. 8, 2024

(54) BUILDING SYSTEM

(71) Applicant: Rustin J Russo, Phoenix, AZ (US)

(72) Inventor: Rustin J Russo, Phoenix, AZ (US)

( * ) Notice: Subject to any disclaimer, the term of this patent is extended or adjusted under 35 U.S.C. 154(b) by 162 days.

(21) Appl. No.: 17/957,951

(22) Filed: Sep. 30, 2022

(65) Prior Publication Data

US 2023/0094441 A1 Mar. 30, 2023

Related U.S. Application Data

(60) Provisional application No. 63/250,794, filed on Sep. 30, 2021.

(51) Int. Cl.
*E04B 5/10* (2006.01)
*E04B 1/348* (2006.01)

(52) U.S. Cl.
CPC ..... *E04B 5/10* (2013.01); *E04B 1/34815* (2013.01)

(58) Field of Classification Search
CPC ..... E04B 5/10; E04B 1/34815
USPC ..... 52/292
See application file for complete search history.

(56) References Cited

U.S. PATENT DOCUMENTS 1,976,967 A * 10/1934 Scullin ..... E04B 1/24 52/653.1
2,186,538 A * 1/1940 Slayter ..... E04B 1/10 52/274
2,194,279 A * 3/1940 Goldsborough ..... E02D 27/10 405/149
2,482,918 A * 9/1949 Kump, Jr. ..... E04B 1/34815 52/762
3,593,469 A * 7/1971 Wall ..... E03C 1/01 52/27
3,600,863 A * 8/1971 Nachtsheim ..... E04B 1/215 52/764
3,680,530 A * 8/1972 Drawsky ..... A01K 1/0151 119/529

(Continued)

FOREIGN PATENT DOCUMENTS

CA 2197032 A1 * 8/1998 ..... E04B 5/10
CN 111485653 B * 6/2021 ..... E04B 5/023

(Continued)

*Primary Examiner* — Brian D Mattei
*Assistant Examiner* — Joseph J. Sadlon
(74) *Attorney, Agent, or Firm* — Plager Schack LLP; Mark H. Plager, Esq.; Naomi Mann, Esq.

(57) ABSTRACT

Disclosed is an assembly for a flooring support structure of a prefabricated or factory made building, comprising a plate configured to boarder a peripheral edge of the flooring support structure in perpendicular planar configuration to the flooring support structure and a floor joist assembly coupled between an outer structural support beam of the flooring support structure and the plate. The floor joist assembly is configured to position below a wall framing structure supported atop the flooring support structure and to provide an open space below the wall framing structure to enable utility components to be contained within and run down the wall structure and through the open space. The disclosed assembly further allows installation of waterproofing on the exterior of the building structure and enables an exterior finish to terminate above grade level for exterior drainage and superior waterproofing.

10 Claims, 4 Drawing Sheets

(56) References Cited

U.S. PATENT DOCUMENTS 3,688,457 A * 9/1972 Sherno ..... E02D 31/14 52/292
3,745,730 A * 7/1973 Layne ..... E04B 1/34853 52/236.9
3,906,686 A * 9/1975 Dillon ..... E04B 1/34869 52/262
4,050,215 A * 9/1977 Fisher ..... E04B 1/34815 D25/1
4,330,970 A * 5/1982 Bonink ..... E04B 1/215 52/236.7
4,457,116 A * 7/1984 Kump ..... E03C 1/01 52/220.2
4,512,120 A * 4/1985 Lindal ..... E04B 1/34321 52/143
4,788,802 A * 12/1988 Wokas ..... E04B 1/34869 52/34
5,054,252 A * 10/1991 Newman ..... E02D 31/008 52/302.1
5,152,108 A * 10/1992 Madl, Jr. ..... E02D 27/02 52/DIG. 11
5,224,321 A * 7/1993 Fearn ..... E02D 27/02 52/250
5,351,458 A * 10/1994 Lehe ..... A01K 1/015 52/177
5,791,100 A * 8/1998 Schieferly ..... E04B 1/003 52/480
6,301,851 B1 * 10/2001 Matsubara ..... E04H 7/18 52/745.1
6,883,281 B1 * 4/2005 Chavez-Gandara ..... E04B 2/44 52/223.7
7,941,975 B2 * 5/2011 Ingjaldsdottir ..... E04C 2/34 52/235
8,061,108 B2 * 11/2011 Tonyan ..... E02D 27/02 428/192
8,429,871 B2 * 4/2013 Ingjaldsdottir ..... E04H 1/00 52/271
8,701,357 B2 * 4/2014 Kovel ..... E04B 1/00 52/236.4
8,950,151 B2 * 2/2015 Strickland ..... E04B 1/24 52/696
10,837,166 B2 * 11/2020 Yang ..... E04B 5/10
11,746,525 B2 * 9/2023 Thomson ..... E04B 5/12 52/582.1
11,781,312 B1 * 10/2023 Hall ..... B60P 1/52 52/29
11,987,975 B2 * 5/2024 Unger ..... E04H 3/08
12,023,765 B1 * 7/2024 Martin ..... B23K 9/202
2004/0134162 A1 * 7/2004 Douglas ..... E04B 1/12 52/741.1
2008/0028719 A1 * 2/2008 Rutledge ..... E04B 5/10 52/690
2010/0031587 A1 * 2/2010 Weeks ..... E04C 3/07 52/126.6
2010/0236158 A1 * 9/2010 Carbonaro ..... E04H 9/14 52/712
2011/0229686 A1 * 9/2011 Dueker ..... E04B 5/12 428/119
2014/0041328 A1 * 2/2014 Stehle ..... E04B 5/19 52/250
2020/0256049 A1 * 8/2020 Golledge ..... E04C 3/06
2024/0191497 A1 * 6/2024 Leung ..... H02J 7/0042
2024/0209620 A1 * 6/2024 Frederiks ..... E04B 5/023
2024/0271411 A1 * 8/2024 Jaenicke ..... E04B 1/34815

FOREIGN PATENT DOCUMENTS

DE 2063109 A1 * 7/1971 ..... E04B 1/34815
DE 19815083 A1 * 10/1999 ..... E02D 31/02
ES 2563248 A1 * 3/2016 ..... A47C 13/00
FR 1171191 A * 1/1959 ..... E04B 1/34815
FR 2733263 A1 * 10/1996 ..... E04B 5/04
GB 1021361 A * 3/1966 ..... E04B 1/34815
GB 2365883 A * 2/2002 ..... E04B 5/10
JP 57133932 A * 8/1982 ..... E02D 27/01
WO WO-03044298 A1 * 5/2003 ..... E04B 5/10
WO WO-2013028072 A1 * 2/2013 ..... E04B 5/04
WO WO-2015087070 A1 * 6/2015 ..... E04B 1/24
WO WO-2021215937 A1 * 10/2021 ..... E04C 2/292

* cited by examiner

BUILDING SYSTEM

RELATED APPLICATION

This application claims benefit to U.S. Provisional Application No. 63/250,794 filed on Sep. 30, 2021, which is incorporated by reference herein in its entirety.

BACKGROUND

The present disclosure relates generally to building systems and more specifically to factory-built, modular and/or prefabricated building systems and components.

Factory-built building structures typically require utility runs such as plumbing, electrical, gas, sewage, etc., to be diverted around the floor structural systems. Exposed utilities in factory-built building kitchen designs may affect cleanliness, ease of maintenance, and aesthetics. Additional corners and material collect debris and build up dirt over time, making for a less sanitary work area. As such, there is a need for an improved system that addresses at least the above-mentioned limitation of the prior art.

SUMMARY

According to various embodiments, disclosed is an assembly for a flooring support structure of a prefabricated or factory made building, the flooring support structure including a foundation, a floor deck above the foundation, and an outer structural support beam between the foundation and floor deck, the outer structural support beam running parallel to a first peripheral edge of the flooring support structure, the assembly comprising: a plate configured to boarder the first peripheral edge of the flooring support structure in perpendicular planar configuration to the flooring support structure; and a floor joist assembly coupled between the outer structural support beam of the flooring support structure and the plate, wherein the flooring support structure is configured to support a wall framing structure, wherein the floor joist assembly is configured to position below the wall framing structure and to provide an open space below the wall framing structure to enable utility components to be contained within and run down the wall structure and through the open space. In certain embodiments, the outer structural support beam is a metal I-beam. In some embodiments, the outer structural support beam is one of a plurality of structural support beams that run parallel to the first peripheral edge, wherein the outer structural support beam is the structural support beam closest to the first peripheral edge. In further embodiments, the assembly may comprise an angle coupled between the plate and the floor joist assembly. In some embodiments, a vertical wall of the angle is welded to an inner side of the plate at a bottom end portion of the plate. In further embodiments, a bottom end portion of the joist assembly is supported on a horizontal wall of the angle and mechanically coupled thereto. In certain embodiments, a distance between the outer structural support beam and the plate is approximately 2 feet. In yet further embodiments, the plate surrounds a perimeter of the flooring support structure include a second peripheral edge perpendicular to the first peripheral edge.

According to various embodiments, disclosed is an assembly method for a flooring support structure of a prefabricated or factory made building, the method comprising: installing a plate at a first peripheral edge of the flooring support structure in perpendicular planar configuration to the flooring support structure; and coupling a floor joist assembly between an outer structural support beam of the flooring support structure and the plate, wherein the outer structural support beam runs parallel to the first peripheral edge of the flooring support structure, and is provided between a foundation and a floor deck above the foundation of the flooring support structure, wherein the flooring support structure is configured to support a wall framing structure, wherein the floor joist assembly is configured to position below the wall framing structure and to provide an open space below the wall framing structure to enable utility components to be contained within and run down the wall structure and through the open space. In certain embodiments, the method may further comprise attaching an angle between the plate and the floor joist assembly.

In certain embodiments, the outer structural support beam is a metal I-beam. In some embodiments, the outer structural support beam is one of a plurality of structural support beams that run parallel to the first peripheral edge, wherein the outer structural support beam is the structural support beam closest to the first peripheral edge. In some embodiments, a vertical wall of the angle is welded to an inner side of the plate at a bottom end portion of the plate. In further embodiments, a bottom end portion of the joist assembly is supported on a horizontal wall of the angle and mechanically coupled thereto. In certain embodiments, a distance between the outer structural support beam and the plate is approximately 2 feet. In yet further embodiments, the plate surrounds a perimeter of the flooring support structure include a second peripheral edge perpendicular to the first peripheral edge.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
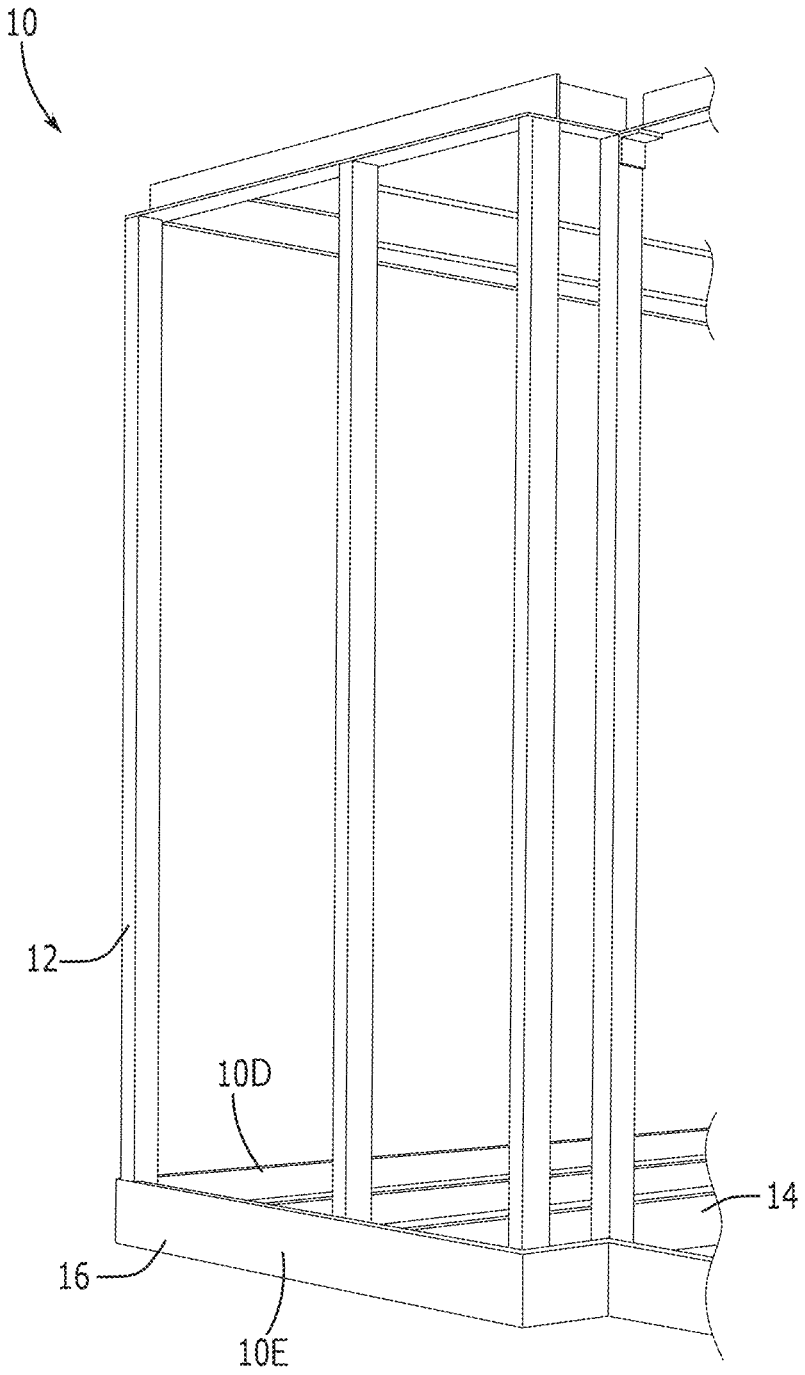
FIG. 1 is a partial perspective view of a building structural system, in accordance with certain embodiments.
Figure 2:
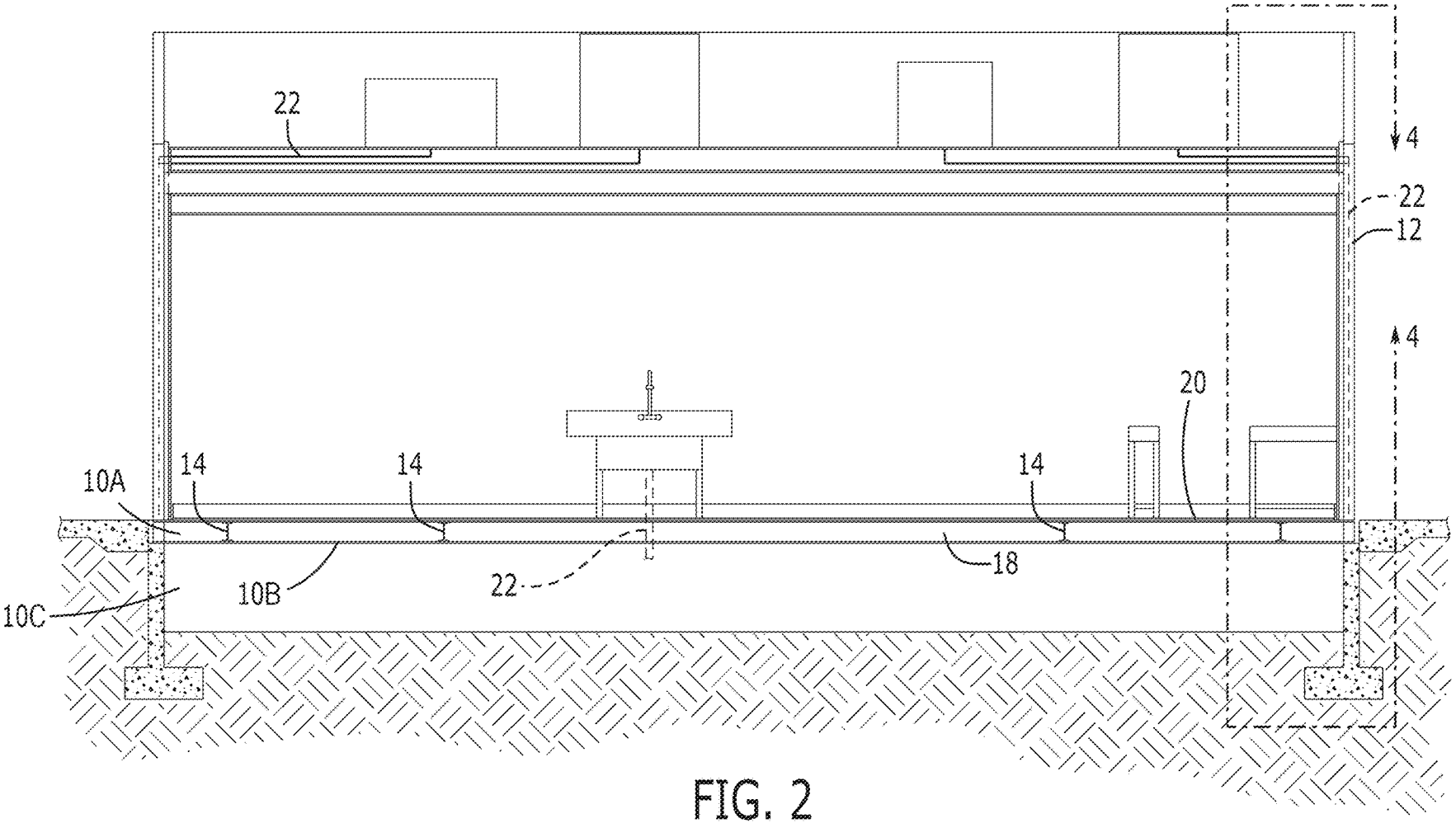
FIG. 2 is a typical elevation view of the building structural system, with parts shown in cross section.
Figure 3:
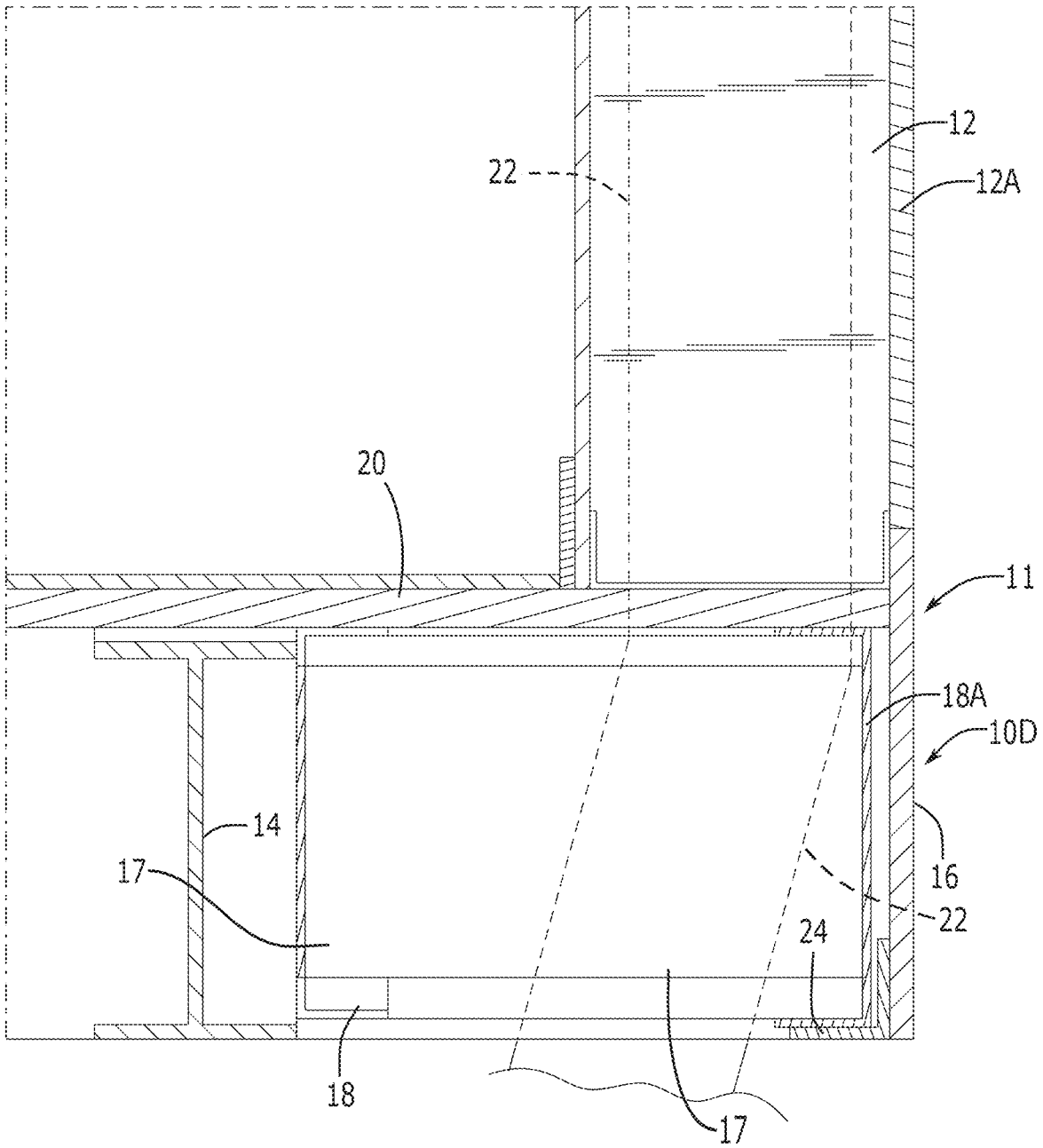
FIG. 3 is a detailed enlarged view of FIG. 4.
Figure 4:
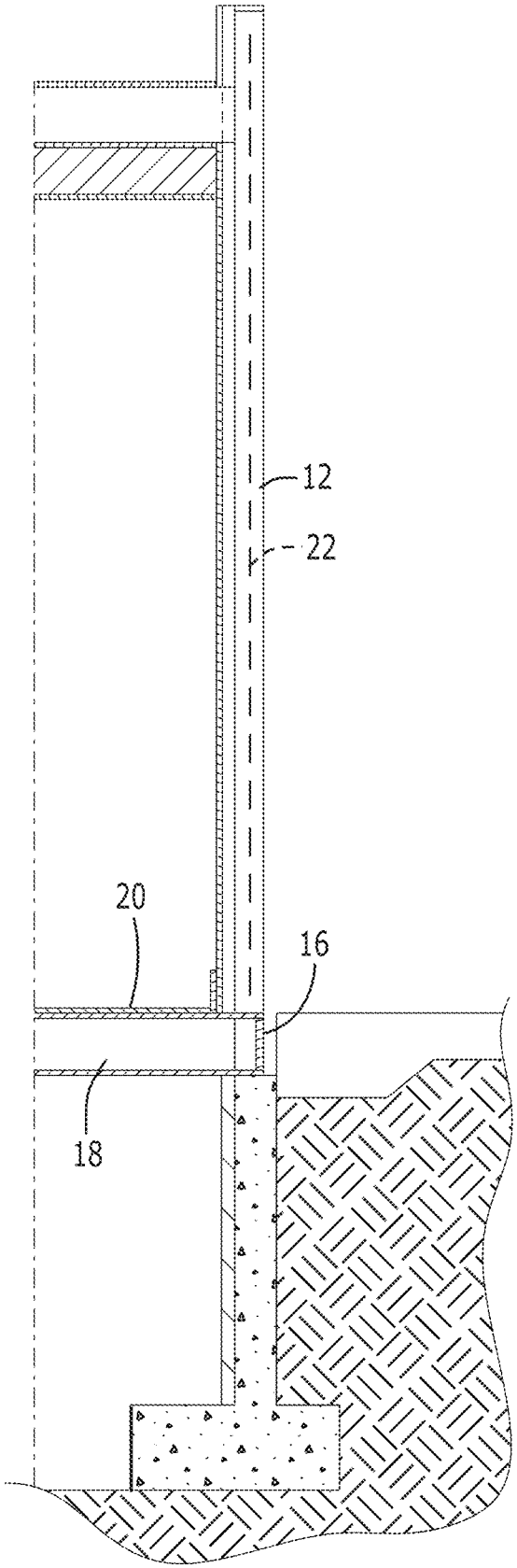
FIG. 4 is a further detailed cross sectional view, indicated by line 4-4 of FIG. 2.

According to various embodiments as depicted in FIGS. 1-4, disclosed is a building structural system 10 for factory-built building structures (i.e., modular, prefabricated building structures) which provides a flooring support structure 10A that allows for utility components 22, including electrical, mechanical, and pluming components, to be fully contained inside the wall system of the building structure and transfer through the flooring support structure 10A. According to various embodiments, this is achieved by transferring building loads to allow the main structural support members of the flooring support structure to be relocated inwardly, i.e., away from the walls system, as will be described.

With reference to FIGS. 1-4, flooring support structure 10A may generally be supported on a foundation 10B provided above a crawl space 10C of the building structure, and includes a top surface or floor deck 20 such as a concrete board which may serve or support a flooring surface within the building as well as wall framing 12 (i.e. steel studs) of the building. In embodiments, floor deck 20 and steel wall framing 12 may be positioned in an arrangement common to standard factory built buildings as is known in the art. Flooring support structure 10A may generally include a series of support beams 14, which may be steel I-beams, that support floor deck 20. In embodiments, support beams 14 (also referred to as "I-beams 14") may generally run parallel to a first peripheral edge 10D of flooring structure 10A, perpendicular to a second peripheral edge 10E of the flooring structure.

In certain embodiments, building structural system 10 provides structural support for deck 20 of the building structure which enables an outer beam 14 (i.e., a beam immediately proximate to peripheral edge 10D, also referred to as "outer beam 14" or "outer I-beam 14") of major support beams 14 to be moved away from peripheral edge 10D. In one embodiment, this is achieved by providing a support assembly 11 comprising a floor joist assembly 18 coupled between a plate 16 (i.e., steel plate 16) at peripheral edge 10D and a side or flange of outer I-beam 14 facing peripheral edge 10D. Plate 16 may boarder flooring structure 10A and may be supported on foundation 10B. In certain embodiments, plate 16 may extend up to floor deck 20. In other embodiments, plate 16 may extend past floor deck 20 and may further be mechanically coupled to an outer side of wall framing 12. In some embodiments, wall boards 12A which may be coupled to wall framing 12 may further be supported atop plate 16. Additionally, all I-beams 14 of flooring structure 10A may be mechanically fastened at their front faces to plate 16 at second peripheral edge 10E.

In some embodiments, support assembly 11 may comprise an angle 24 (i.e., steel angle) that may be welded to an inner side of plate 16 at peripheral edge 10D. In certain embodiments, a vertical wall of angle 24 may be welded at a bottom end portion of plate 16, and a horizontal wall of the angle may be supported on foundation 10B. Joist assembly 18 may further be mechanically coupled to angle 24 opposite plate 16. In one embodiment, joist assembly 18 may be a light gauge steel stud floor joist, and may include a track frame 18A, wherein a bottom end portion of track frame 18A is supported on the horizontal wall of steel angle 24. Additionally, outer I-beam 14 may be mechanically coupled at its side and/or flange to joist assembly 18 opposite angle 24. Thus, joist assembly 18 spans between the beam 14 and steel plate 16 creating open space 17 right below the wall system which enables utility components 22, to run from inside the walls in through the flooring structure. Plate 16, angle 24 and joist assembly 18 create a bearing foundation for the building structure, with outer I-beam 14 distanced from peripheral edge 10D. In one embodiment, outer beam 14 may be positioned approximately 2 feet from peripheral edge 10D.

As such, flooring structure 10A is designed to allow rather than block access to the utility components 22, enabling the utility components to be contained within the wall structure and exit directly into crawl space 10C. Additionally, as metal plate 16 provides a solid steel piece which resides at the exterior of the building structure, the disclosed system further allows installation of waterproofing on the exterior of the building structure and enables an exterior finish to terminate above grade level for exterior drainage and superior waterproofing.

The disclosed system positions structural components including beam 14, joist 18, steel angle 24, and steel plate 16 in a manner which allows utility penetration straight through the structural system while still translating structural loads as required for structural stability. This eliminates any projection, piping or cabling outside of the walls, allowing for a cleaner area and reduced maintenance requirements.

In certain embodiment, the disclosed system may be implemented by first preparing structural shop drawings for the prefabricated components, then obtaining the necessary materials and fabricating the specific components in a shop. The components may then be transported to a fabrication site where they are temporarily braced, squared off and made plumb before welding. Thereby, the structural configuration of the disclosed system may be incorporate into various building plans for factory-built structures.

The disclosed structural system 10 may be used for various building structures, including modular housing manufacturing, RV manufacturing, and the like. It shall be appreciated that the disclosed building structural system 10 can have multiple configurations in different embodiments. It shall be appreciated that the components of building structural system 10 described herein may comprise any alternative known materials in the field and be of any size and/or dimensions. In certain embodiment, the components of building structural system may be made of a metal such as steel. It shall be appreciated that the components of building structural system 10 may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An assembly for a flooring support structure of a prefabricated or factory made building, the flooring support structure including a foundation, a floor deck above the foundation, and an outer structural support beam between the foundation and floor deck, the outer structural support beam running parallel to a first peripheral edge of the flooring support structure, the assembly comprising:

a vertical plate bordering the first peripheral edge of the flooring support structure in perpendicular alignment to the flooring support structure; and a floor joist assembly coupled between the outer structural support beam of the flooring support structure and the plate, wherein the flooring support structure supports a wall framing structure, wherein the floor joist assembly is positioned below the wall framing structure and provides continuous open space in the flooring support structure which extends in a vertically uninterrupted path through an area of the flooring support structure located directly below the wall framing structure to enable utility components to be contained within and run down through a cavity of the wall framing structure and the continuous open space in said area of the flooring support structure directly below the wall framing structure to a crawl space below the flooring support structure in a vertically straight path, wherein the outer structural support beam is one of a plurality of structural support beams that run parallel to said first peripheral edge, the outer structural support beam being the beam closest to the first peripheral edge, wherein the outer structural support beam is laterally distanced from the wall framing structure and the vertical plate at the first peripheral edge to allow for said continuous open space, wherein the continuous open space has an uninterrupted width which is greater than the width of the cavity of the wall framing structure, and wherein the assembly is an integral component of the prefabricated or factory made building and is movable with the prefabricated or factory made building.

2. The assembly of claim 1, wherein the outer structural support beam is a metal I-beam.

3. The assembly of claim 2, wherein the floor joist assembly is positioned between the vertical plate at the first peripheral edge and a flange of the metal I-beam of the outer structural support beam, said flange facing the first peripheral edge.

4. The assembly of claim 1, further comprising an angle coupled between the vertical plate and the floor joist assembly.

5. The assembly of claim 4, wherein a vertical wall of the angle is welded to an inner side of the vertical plate at a bottom end portion of the vertical plate.

6. The assembly of claim 5, wherein a bottom end portion of the joist assembly is supported on a horizontal wall of the angle and is mechanically coupled thereto.

7. The assembly of claim 1, wherein a distance between the outer structural support beam and the vertical plate is approximately 2 feet.

8. The assembly of claim 1, wherein the vertical plate surrounds a perimeter of the flooring support structure including a second peripheral edge perpendicular to the first peripheral edge.

9. An assembly method for a flooring support structure of a prefabricated or factory made building, the method comprising:

installing a vertical plate at a first peripheral edge of the flooring support structure in perpendicular alignment to the flooring support structure; and coupling a floor joist assembly between an outer structural support beam of the flooring support structure and the vertical plate, wherein the outer structural support beam runs parallel to the first peripheral edge of the flooring support structure, and is provided between a foundation and a floor deck above the foundation of the flooring support structure, wherein the flooring support structure supports a wall framing structure, wherein the floor joist assembly is positioned below the wall framing structure and provides a continuous open space in the flooring support structure which extends in a vertically uninterrupted path through an area of the flooring support structure located directly below the wall framing structure to enable utility components to be contained within and run down through a cavity of the wall framing structure and through the continuous open space in said area of the flooring support structure directly below the wall framing structure to a crawl space below the flooring support structure in a vertically straight path, wherein the outer structural support beam is one of a plurality of structural support beams that run parallel to said first peripheral edge, the outer structural support beam being the beam closest to the first peripheral edge, wherein the outer structural support beam is laterally distanced from the wall framing structure and the vertical plate at the first peripheral edge to allow for said continuous open space, and wherein the continuous open space has an uninterrupted width which is greater than the width of the cavity of the wall framing structure.

10. The assembly method of claim 9, further comprising attaching an angle between the vertical plate and the floor joist assembly.

* * * * *